United States Patent [19]

Weaver

[11] 4,077,428

[45] Mar. 7, 1978

[54] TRANSPORTABLE WATER INJECTION PLANT

[75] Inventor: Dale L. Weaver, Worland, Wyo.

[73] Assignee: Dale Weaver, Inc., Worland, Wyo.

[21] Appl. No.: 653,520

[22] Filed: Jan. 29, 1976

[51] Int. Cl.[2] ..... F04B 17/06

[52] U.S. Cl. ..... 137/567; 417/231

[58] Field of Search ..... 137/565, 567, 375; 417/234, 231, 233

[56] References Cited

U.S. PATENT DOCUMENTS

| | | | |
|---|---|---|---|
| 1,528,036 | 3/1925 | Wagner | 137/565 |
| 1,617,095 | 2/1927 | Bacher | 137/565 |
| 2,669,483 | 2/1954 | Fletcher | 137/565 X |
| 3,039,396 | 6/1962 | Hollander | 417/234 |
| 3,110,263 | 11/1963 | Thompson | 417/231 |
| 3,398,887 | 8/1968 | Fraser et al. | 137/375 X |
| 3,431,940 | 3/1969 | Hanley | 137/565 |
| 3,478,958 | 11/1969 | Hinck et al. | 417/234 |
| 3,567,342 | 3/1971 | Jackson | 417/234 |
| 3,885,892 | 5/1975 | Dwyer et al. | 417/234 |
| 4,004,862 | 1/1977 | Hill et al. | 417/234 |

*Primary Examiner*—William R. Cline
*Attorney, Agent, or Firm*—Vogel, Dithmar, Stotland, Stratman & Levy

[57] ABSTRACT

A portable water injection plant for use either in waterflooding operations in secondary recovery of oil from an underground formation penetrated by oil recovery wells and water injection wells, or in water disposal operations, includes a basic portable plant module comprising a portable foundation having a water pump mounted thereon and having electrical wiring and fluid conduits preassembled on the foundation, the fluid conduits including an intake header coupled to the water inlet of the pump and a discharge header coupled to the water outlet of the pump. Coupling means are provided for readily detachably coupling the intake header to one or more associated water sources and the discharge header to one or more water injection wells. Auxiliary portable plant modules may be readily detachably coupled to the basic plant module and to additional water sources to increase the pumping capacity of the water injection plant.

11 Claims, 5 Drawing Figures

TRANSPORTABLE WATER INJECTION PLANT

BACKGROUND OF THE INVENTION

The present invention relates to water injection plants for secondary recovery of oil from underground formations which are penetrated by oil recovery wells and water injection wells, the recovery process involving injection of water under pressure into the formation to force oil to the oil recovery wells, all in a well-known manner. The invention may also be used to inject water into underground formations or storage areas for water disposal purposes. Prior art water injection plants have been in the form of permanent installations at or near a water injection well site, the plants including pumping mechanism and associated plumbing and electrical networks, all of which were mounted on a permanent concrete foundation and preferably enclosed in a suitable housing or building. In such prior art water injection plants, when the secondary recovery operation is completed, the plants have to be dismantled in order to be removed from the site, leaving behind a concrete foundation which must somehow be disposed of, usually at considerable expense. The plant must then be reassembled in order to be used at another location and the cost of assembly and disassembly is then repeated.

The concept of portable foundations for machinery is known in the prior art as illustrated, for example, in U.S. Pat. No. 2,099,898, issued to E. T. Larkin on Nov. 23, 1937. But this concept has not been applied to water injection plants for oil field operations. Furthermore, the prior art portable foundation of the Larkin patent simply comprises a platform upon which machinery may rest in the field, and does not avoid the problem of field assembly and disassembly of equipment to form a plant such as a waterflood or water disposal plant, which may include a considerable amount of plumbing and electrical circuitry.

BRIEF SUMMARY OF THE INVENTION

In the present invention there is provided a water injection plant which is of preassembled modular construction and which is fully portable, so that entire plant modules may readily be moved from site to site without any assembly or disassembly, the only on-site operations necessary being the coupling of the plant modules to the on-site well, water source and power source.

It is a general object of the present invention to provide a portable water injection plant which is prewired and preplumbed and which is constructed as an integrated basic unit, the invention also including auxiliary integrated water injection plant units or modules which may be interconnected with a basic unit in the field to increase the total pumping capacity of the entire water injection plant.

It is an important object of the present invention to provide a portable water injection plant for secondary recovery of oil from an underground formation penetrated by oil recovery wells and water injection wells, said water injection plant comprising a portable foundation adapted to be moved to and from a water injection well site and to rest upon the ground thereat, pumping mechanism mounted on the foundation and having a water inlet and a water outlet and operable for moving water under pressure from the water inlet to the water outlet, intake conduit means mounted on the foundation and coupled to the water inlet and adapted to be readily detachably coupled to an associated source of water for receiving water therefrom, discharge conduit means mounted on the foundation coupled to the water outlet and adapted to be readily detachably coupled to an associated water injection well for injecting water into the underground formation, control means carried by the foundation and coupled to the pumping mechanism for controlling the operation thereof, and connection means carried by the foundation for readily detachably connecting said pumping mechanism and the control means to an external source of power for operation of the water injection plant.

It is another object of this invention to provide a portable water injection plant of the type set forth, wherein the equipment mounted on the portable foundation is completely enclosed within a thermally insulated housing.

In connection with the foregoing objects, it is another object of this invention to provide a portable water injection plant of the type set forth, wherein the intake conduit means are adapted to be readily detachably coupled in parallel to a plurality of associated water sources, and the discharge conduit means are adapted to be readily detachably coupled in parallel to a plurality of associated water injection wells.

Still another object of this invention is to provide a portable water injection plant which comprises a basic plant module of the type set forth, and at least one auxiliary plant module having pumping mechanism, intake conduit means, discharge conduit means and connection means, and further including means readily detachably coupling the auxiliary intake conduit means to the basic intake conduit means and readily detachably coupling the auxiliary discharge conduit means to the basic discharge conduit means, whereby the pumping capacity of the portable water injection plant may be varied by varying the number of auxiliary plant modules thereof.

Further features of the invention pertain to the particular arrangement of the parts of the portable water injection plant whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENTS

Figure 1:
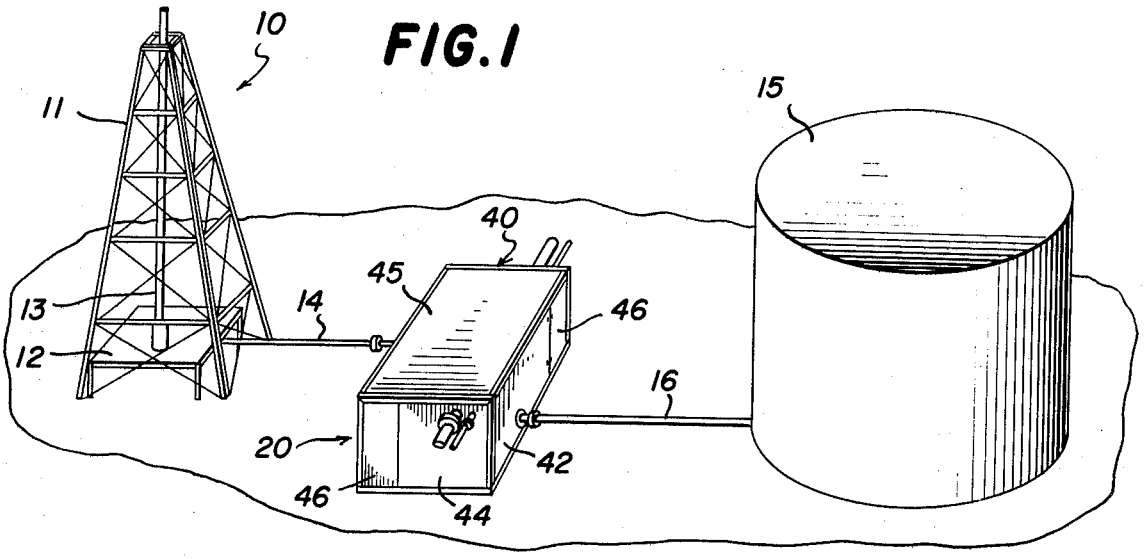
FIG. 1 is a perspective view of a basic portable water injection plant unit constructed in accordance with and embodying the features of the present invention, as installed in the field and coupled to a water injection well and a water source.

In FIG. 1 there is illustrated the field site of a water injection well for use in secondary recovery of oil from an underground formation. At the site is located a water injection well, generally designated by the numeral 10, including a derrick 11 and a drilling platform 12 and a well casing or pipe 13, all of well-known standard construction. The water injection well 10 is connected by a water pipe 14 to a basic portable water injection plant unit or module, generally designated by the numeral 20, constructed in accordance with and embodying the features of the present invention. The basic water injection plant module 20 is in turn connected by a water pipe 16 to a water storage tank 15, which is illustrated as being located closely adjacent to the injection well 10. It will be understood that in accordance with standard secondary recovery procedures, the water injection plant module 20 operates to pump the water under pressure from the tank 15 into the injection well 10 for flooding the underground formation and driving the underground oil deposits toward an oil recovery well or wells. It will also be understood that, in normal secondary recovery operation, an array of water injection wells 10 is arranged in a predetermined formation with respect to the underground oil formation and with respect to the oil recovery wells for optimizing the efficiency of oil recovery from the underground formation. The water injection plant module 20 may, of course, also be used to inject water into underground formations or cavities for other purposes, e.g., water disposal. While the water tank 15 has been illustrated as being disposed closely adjacent to the water injection well 10, it will be understood that the water could also be piped to the well site from a distant reservoir.

Figure 2:
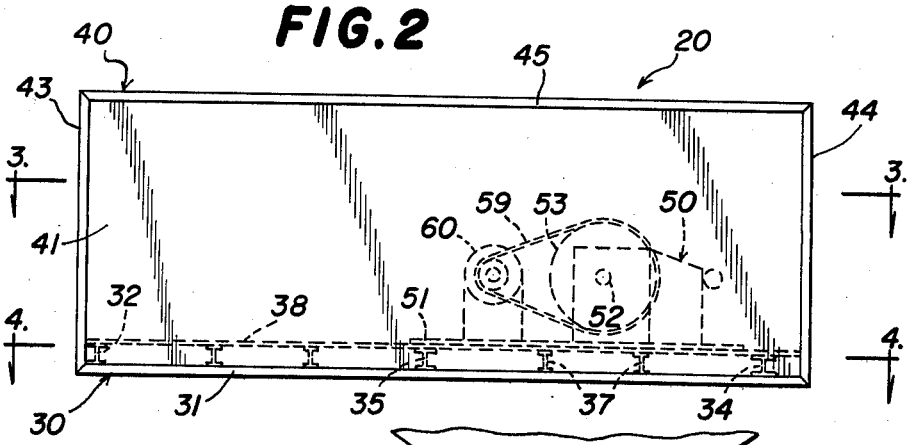
FIG. 2 is an enlarged side elevational view of the portable water injection plant of FIG. 1.
Figure 3:
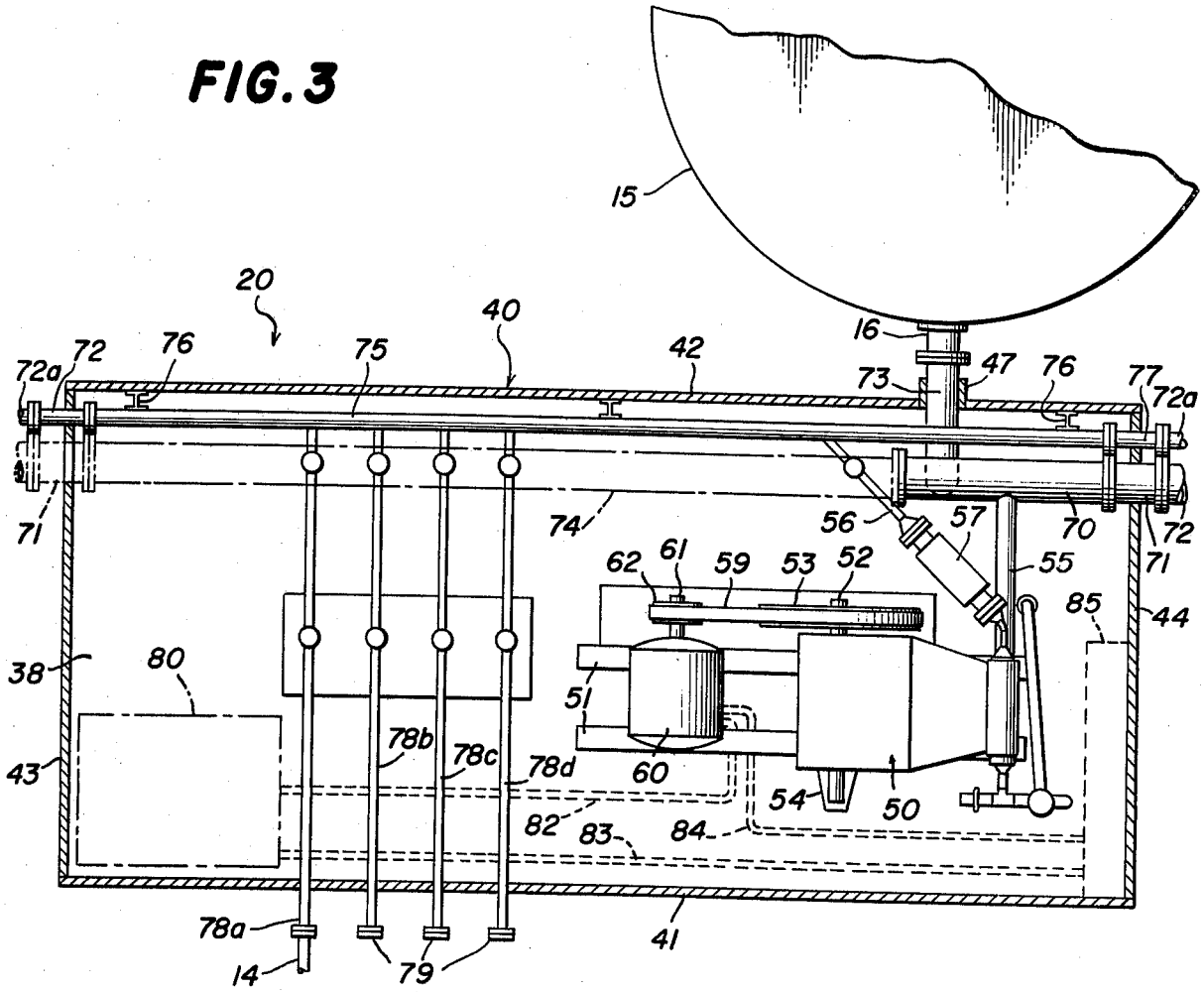
FIG. 3 is a further enlarged view in horizontal section taken along the line 3—3 in FIG. 2 and illustrating the equipment mounted on the portable foundation.
Figure 4:
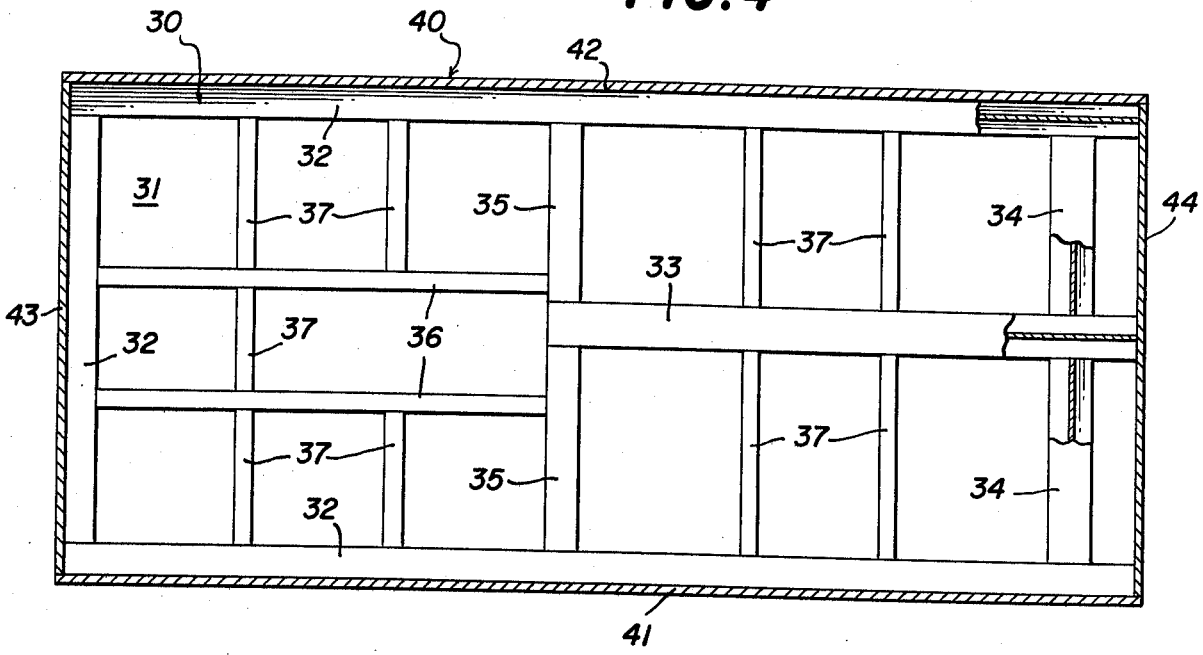
FIG. 4 is an enlarged view in horizontal section taken along the line 4—4 in FIG. 2, illustrating the construction of the portable foundation of the water injection plant of the present invention, with portions of the foundation broken away more clearly to show the construction thereof.

Referring now to FIGS. 2 through 4 of the drawings, the construction of the portable basic water injection plant module 20 will be described in detail. The basic module 20 includes a portable foundation, generally designated by the numeral 30, preferably constructed of steel. The foundation 30 includes a flat rectangular base plate 31 on which is disposed a network of steel H-beams, including three peripheral beams 32 respectively extending along the opposite side edges and one end edge of the base plate 31, a central heavy beam 33, disposed substantially midway between the side peripheral beams 32 and parallel thereto and extending from a point adjacent to the open ends of the side peripheral beams 32 to a point about midway between the ends thereof. Two heavy end beams 34 respectively extend from the two side peripheral beams 32 to the central beam 33 substantially normal thereto and adjacent to the open end thereof, the other end of the central beam 33 being connected to the side peripheral beams 32 by two intermediate beams 35 which are parallel to the end beams 34. Respectively connected to the intermediate beams 35 on either side of the central beam 33 and parallel thereto are two small longitudinal beams 36 which extend to the end peripheral beam 32. A plurality of small transverse beams 37 interconnect the longitudinal beams 36 with each other and also interconnect the longitudinal beams 36 and the central beam 33 with the side peripheral beams 32. Overlying the network of beams 32 through 37 and fixedly secured thereto and substantially congruent with the base plate 31 is a rectangular deck 38.

The base plate 31, the beams 32 through 37 and the deck 38 are all interconnected to form a rigid unified structure, the parts preferably being bolted together. However, it will be understood that the members of the portable foundation 30 could also be secured together by other suitable fastening means such as rivets, welding or the like. The base plate 31 provides a broad bearing surface for the portable foundation 30 so that it may be placed upon soft soil or uneven surfaces with a minimum of sinkage.

Mounted on the portable foundation 30 and completely encompassing the deck 38 is a housing, generally designated by the numeral 40, which preferably includes a pair of opposed upstanding rectangular parallel side walls 41 and 42, respectively secured to the side peripheral beams 32 and extending upwardly therefrom, and a pair of opposed rectangular parallel end walls 43 and 44 interconnecting the side walls 41 and 42 at the opposite ends thereof, with the end wall 43 being secured to the end peripheral beam 32, and the end wall 44 being secured to the adjacent ends of the side peripheral beams 32 and central beam 33. Interconnecting the walls 41 through 44 at the upper edges thereof and completely covering the space therebetween is a flat rectangular top wall 45 which is substantially congruent with the deck 38. The housing 40 may be provided with one or more access doors 46 formed in one or more of the walls 41 through 44.

Preferably, the walls 41 through 45 are all thermally insulated by suitable means to protect the equipment within the housing 40 from temperature extremes, and to prevent freezing of water as it is processed through the portable water injection plant module 20. In this regard, suitable heating means (not shown) may be provided within the housing 40, for maintaining the temperature inside the housing 40 well above the freezing point of water. Suitable electric lighting means (not shown) may also be provided in the housing 40. Formed in an aperture in the side wall 42 is a sleeve or bushing 47 for a purpose to be described more fully below.

A pump, generally designated by the numeral 50, is mounted on a pair of parallel spaced-apart mounting rails 51 which are fixedly secured to the upper surface of the deck 38 adjacent to the right-hand end thereof, as viewed in FIG. 3, and generally midway between the side walls 41 and 42 substantially parallel thereto. The pump 50 is fixedly secured to the mounting rails 51 by suitable means, the pump 50 having a drive shaft 52 fixedly secured adjacent to one end thereof to a drive wheel 53 and provided at the other end thereof with a lubricating mechanism 54. The pump 50 is provided with a water inlet pipe 55 and a water outlet pipe 56, both the inlet and outlet pipes 55 and 56 preferably being provided with dampeners as at 57.

The drive wheel 53 is coupled by a drive belt 59 to a sheave 62 fixedly secured to the output shaft 61 of a drive motor 60, which motor is also mounted upon and fixedly secured to the mounting rails 51. Preferably, the drive motor 60 is a 100 hp, 3 phase, 60 cycle, 460 volts electric motor. It will be understood that the mounting rails 51 serve to reinforce the deck 38, and also serve to distribute the weight of the pump 50 and drive motor 60 along the portable foundation 30. In operation, the pump 50 operates in a well-known manner to move water under pressure from the water inlet pipe 55 to the water outlet pipe 56.

The water inlet pipe 55 of the pump 50 is coupled to and communicates with a relatively large-diameter water intake manifold or header conduit 70 mounted on the portable foundation 30, the header conduit 70 also being coupled to and communicating with a water source conduit 73 which projects through the sleeve 47 in the housing side wall 42, and is provided at the distal end thereof with a coupling flange for coupling to the adjacent end of the outlet pipe 16 from the water tank 15. The header conduit 70 extends substantially parallel to the housing side wall 42 adjacent thereto and within the housing 40, the opposite ends of the header conduit 70 being respectively disposed closely adjacent to the end walls 43 and 44 and adapted to be coupled by coupling spools 71 which project through complementary openings in the end walls 43 and 44, to the adjacent ends of sections 72 disposed externally of the housing 40.

The water outlet pipe 56 is coupled to and communicates with a water discharge manifold or header conduit 75 which extends parallel to the intake header conduit 70 closely adjacent thereto, the opposite ends of the discharge header conduit 75 respectively terminating adjacent to the inner surfaces of the end walls 43 and 44, and being respectively coupled by coupling spools 77 extending through complementary openings in the end walls 43 and 44 to the adjacent ends of the discharge conduit sections **72*a* disposed externally of the housing 40. Also coupled to the discharge header conduit 75 and communicating therewith are a plurality of parallel well outlet pipes 78*a*, 78*b*, 78*c* and 78*d* extending transversely of the housing 40 and projecting outwardly through complementary openings in the housing side wall 41, the well outlet pipe 78*a* being provided at the outer end thereof with a coupling flange for coupling to the adjacent end of the water inlet pipe 14 of the injection well 10 for injecting water thereinto. The well outlet pipes 78*b* through 78*d* are respectively adapted for coupling to other water injection wells 10 and, when not in use, are capped by suitable cap means 79**.

It will be appreciated that the coupling flanges on the well outlet pipes **78*a* through 78*d* and on the water source conduit 73, as well as the coupling spools 71 and 77 for the intake header conduit 70 and discharge header conduit 75, respectively, permit the portable water injection plant 20 to be readily detachably connected to one or more water sources and to one or more water injection wells. In this regard, it will be understood that the adjacent external conduit sections 72, coupled to the intake header conduit 70 may be coupled to other sources of water such as other water tanks 15**.

Also mounted on the deck 38 within the housing 40 is a control apparatus 80 for controlling the operation of the electric drive motor 60 and the pump 50, as well as the other equipment of the portable water injection plant 20. The control apparatus 80 is coupled by connecting cables 82 and 83, respectively, to the electric motor 60 and to a connection plug terminal 85, the plug terminal 85 also being coupled by a cable 84 to the electric drive motor 60. It will be understood that the plug terminal 85 is adapted to be connected to on-site external sources of electrical power, and is also adapted to be coupled to other power sources such as gas lines, steam lines and the like, which may be used, for example, to provide heat for the interior of the housing 40. It will be appreciated that the control apparatus 80 also serves to control other equipment in the housing 40 such as heating and lighting equipment, and may also be utilized to provide remote control of valves and the like.

In operation, the pump 50 is driven by the electric drive motor 60 to pump water from the tank 15 through the water intake header conduit 70 and the water inlet pipe 55 through the pump 50 to the water outlet pipe 56 and water discharge header conduit 75 and thence to the water injection wells 10 via the well outlet pipes **78*a* through 78*d*. When the basic water injection plant 20 is being used alone and in connection with a single water source, the ends of the water intake header conduit 70 and water discharge header conduit 75** are capped by suitable means.

Figure 5:
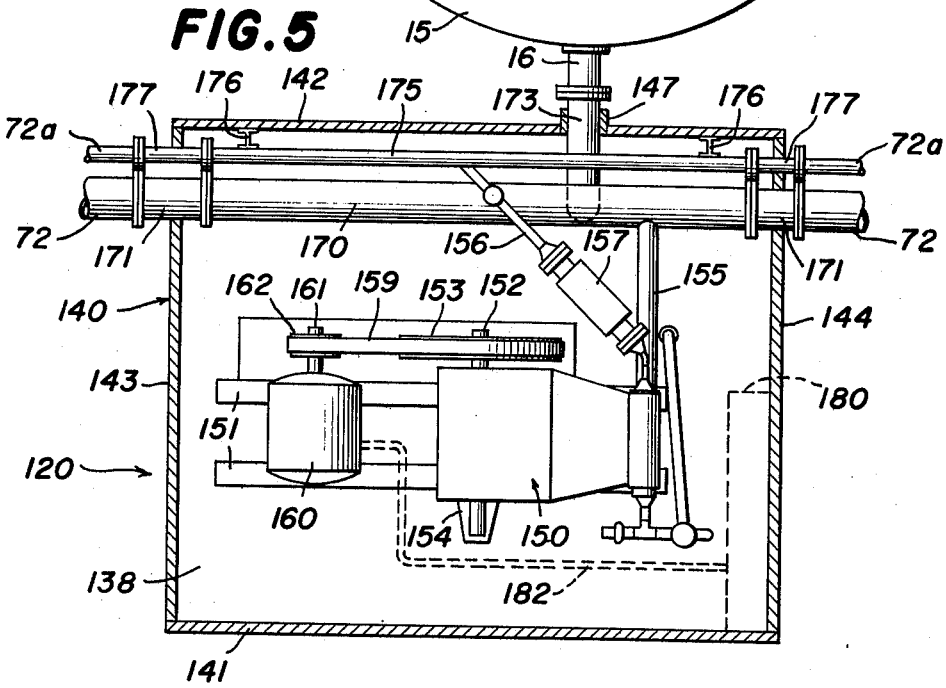
FIG. 5 is a view similar to FIG. 3, showing an auxiliary water injection plant module for use in combination with the basic unit of FIGS. 1 through 4.

Referring now also to FIG. 5 of the drawings, there is illustrated an auxiliary water injection plant module, generally designated by the numeral 120, which is similar in construction to the basic water injection plant module 20, the parts of the auxiliary module 120 which correspond to like parts in the basic module 20 being respectively given numbers which are equal to the corresponding numbers in the basic module 20, plus 100. The auxiliary plant module 120 includes an auxiliary portable foundation (not shown) which may be constructed identically to the right-hand portion of the basic module portable foundation 30, as viewed in FIG. 4, i.e., the portion beginning with the intermediate beams 35 and extending to the right therefrom. The auxiliary portable foundation includes a flat rectangular deck 138, on which is mounted a housing, generally designated by the numeral 140, which includes a pair of rectangular parallel upstanding side walls 141 and 142 interconnected to the opposite ends thereof by a pair of rectangular upstanding end walls 143 and 144. Preferably, a flat rectangular top wall (not shown) interconnects the walls 141 through 144 at the upper edges thereof and is substantially congruent to the auxiliary portable foundation. Thus, the housing 140 is similar to the housing 40, except for its length, the walls of the housing 140 being thermally insulated as was described above with respect to the housing 40. Formed in an aperture in the side wall 142 is a cylindrical sleeve or bushing 147, the construction and purpose of which is the same as the sleeve 47.

A pump 150 is mounted on a pair of parallel spaced-apart mounting rails 151 fixedly secured to the deck 138 and extending longitudinally thereof, the pump 150 having a drive shaft 152, adjacent to one of which is fixedly secured a drive wheel 153, the other end of the drive shaft 152 being provided with a lubricating mechanism 154. The pump 150 is provided with a water inlet pipe 155 and a water outlet pipe 156, both the pipes 155 and 156 being provided with dampeners 157.

The drive wheel 153 is coupled by a drive belt 159 to a sheave 162 fixedly secured adjacent to one end of an output shaft 161 of an electric drive motor 160, which is also fixedly secured to the mounting rails 151. The parts 150 through 162 may respectively be identical to the parts 50 through 62 of the basic water injection plant module 20.

The water inlet pipe 155 is coupled to and communicates with a water intake header conduit 170, which is in turn coupled to and communicates with a tank conduit 173 which projects through the sleeve or bushing 147 and is provided at the outer end thereof with a coupling flange for coupling to a mating flange on the adjacent end of a water tank outlet pipe 16. The intake header conduit 170 is provided at the opposite ends thereof with coupling spools 171 for coupling to adjacent pipe sections 72 disposed externally of the housing 140. The water outlet pipe 156 is coupled to and communicates with a water discharge conduit 175, provided at the opposite ends thereof with coupling spools 177 to permit coupling to adjacent discharge conduit sections 72*a* disposed externally of the housing 140.

Carried by the deck 138 is a control and connection plug terminal 180 adapted to be coupled to external on-site sources of electrical or other power or, alternatively, to be connected to the control and connection plug terminals of other auxiliary water injection plant modules 120 or to the connection plug terminal 85 of the basic water injection plant module 20. The plug terminal 180 is connected by a cable 182 to the electric drive motor 160, it being understood that the plug terminal 180 will also be connected by suitable means to heating, lighting or other equipment which may be provided within the housing 140.

In operation, the basic water injection plant module 20 may be coupled to one or more auxiliary water injection plant modules 120 by simply coupling together the intake header conduits 70 and 170 by means of the coupling spools 71 and 171 and the external conduit section 72, and likewise by coupling together the water discharge header conduits 75 and 175 by means of the coupling spools 177 and 77 and the external conduit section 72*a*. It will be understood that auxiliary water injection plant modules 120 may be coupled to the basic water injection plant module 20 at either or both ends thereof, as viewed in FIG. 3, and that auxiliary water injection plant modules 120 may be connected to each other. It will also be understood that each of the auxiliary water injection plant modules 120 may, if desired, be coupled to a water source in addition to that to which the basic water injection plant module 20 is connected.

From the foregoing, it can be seen that there has been provided a novel water injection plant for secondary recovery of oil, wherein the plant is constructed of completely portable integrated units or modules which need only be carried to the well site, and there connected to the well and the on-site water and power sources by coupling means which permit ready detachment of the water injection plant.

There has also been provided a portable water injection plant of the type set forth which requires no permanent foundation and which requires no assembly and/or disassembly of the plant at the well site, an entire plant module being movable to and from the well site as a unit.

There has also been provided a portable water injection plant of the type set forth, which accommodates coupling to a plurality of water sources and to a plurality of injection wells.

In addition, there has been provided a modular type of portable water injection plant including a basic plant module to which may be added any desired number of auxiliary plant modules to increase the water pumping capacity of the water injection plant.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A transportable water injection plant for injecting water into an underground formation penetrated by a water injection well, said water injection plant comprising a free-standing transportable foundation adapted to be moved to and from a water injection well site and to rest upon the ground thereat in a self-supporting condition, pumping mechanism mounted on said foundation and having a water inlet and a water outlet and operable for moving water under pressure from said water inlet to said water outlet, intake conduit means mounted on said foundation and coupled to said water inlet and adapted to be readily detachably coupled to an associated source of water for receiving water therefrom, discharge conduit means mounted on said foundation and coupled to said water outlet, means for detachably coupling said discharge conduit means to an associated water injection well for injecting water into the underground formation, control means carried by said foundation and coupled to said pumping mechanism for controlling the operation thereof, a housing mounted on said transportable foundation and cooperating therewith to enclose said pumping mechanism and said intake and discharge conduit means and said control means, said housing defining a work chamber dimensioned to permit a workman to walk therein for servicing and operating the contents of said housing, and closable access means in said housing to permit a workman to enter and exit said work chamber, and connection means carried by said foundation for readily detachably connecting said pumping mechanism and said control means to an external source of power for operation of said water injection plant.

2. The transportable water injection plant set forth in claim 1, wherein said housing is thermally insulated.

3. The transportable water injection plant set forth in claim 1, wherein said connection means includes means for connection to sources of gas and electricity.

4. The transportable water injection plant set forth in claim 1, wherein said transportable foundation includes a framework of steel beams and a flat rectangular deck supported upon said beams, and further including means for fixedly securing said pumping mechanism to said deck and for distributing the weight of said pumping mechanism along said deck.

5. The transportable water injection plant set forth in claim 1, wherein said pumping mechanism includes an electric-motor-driven pump and an electric motor for driving same.

6. A transportable water injection plant for injecting water into an underground formation penetrated by a water injection well, said water injection plant comprising a free-standing transportable foundation adapted to be moved to and from a water injection well site and to rest upon the ground thereat in a self-supporting condition, pumping mechanism mounted on said foundation and having a water inlet and a water outlet and operable for moving water under pressure from said water inlet to said water outlet, intake conduit means mounted on said foundation and coupled to said water inlet and adapted to be readily detachably coupled in parallel to a plurality of associated sources of water for receiving water therefrom, a plurality of discharge conduit means mounted on said foundation and coupled to said water outlet, means for readily detachably coupling said discharge conduit means in parallel respectively to a plurality of associated water injection wells for injecting water into the underground formation, control means carried by said foundation and coupled to said pumping mechanism for controlling the operation thereof, a housing mounted on said transportable foundation and cooperating therewith to enclose said pumping mechanism and said intake and discharge conduit means and said control means, said housing defining a work chamber dimensioned to permit a workman to walk therein for servicing and operating the contents of said housing, and closable access means in said housing to permit a workman to enter and exit said work chamber, and connection means carried by said foundation for readily detachably connecting said pumping mechanism and said control means to an external source of power for operation of said water injection plant.

7. A portable water injection plant for injecting water into an underground formation penetrated by a water injection well, said water injection plant comprising a basic plant module and at least one auxiliary plant module; said basic plant module including a basic portable foundation adapted to be moved to and from a water injection well site and to rest upon the ground thereat, a basic pumping mechanism mounted on said basic foundation and having a basic water inlet and a basic water outlet and operable for moving water under pressure from said basic water inlet to said basic water outlet, basic intake conduit means mounted on said basic foundation and coupled to said basic water inlet and adapted to be readily detachably coupled in parallel to a plurality of associated sources of water for receiving water therefrom, basic discharge conduit means mounted on said basic foundation and coupled to said basic water outlet and adapted to be readily detachably coupled in parallel to a plurality of associated water injection wells for injecting water into the underground formation, control means carried by said basic foundation and coupled to said basic pumping mechanism for controlling the operation thereof, and basic connection means carried by said basic foundation for readily detachably connecting said basic pumping mechanism and said control means to an external source of power for operation of said basic plant module; each of said auxiliary plant modules including an auxiliary foundation adapted to be moved to and from the water injection well site and to rest upon the ground thereat, auxiliary pumping mechanism mounted on said auxiliary foundation and having an auxiliary water inlet and an auxiliary water outlet and operable for moving water under pressure from said auxiliary water inlet to said auxiliary water outlet, auxiliary intake conduit means mounted on said auxiliary foundation and coupled to said auxiliary water inlet and adapted to be readily detachably coupled to said basic intake conduit means and to an associated source of water for receiving water therefrom, auxiliary discharge conduit means mounted on said auxiliary foundation and coupled to said auxiliary water outlet and adapted to be readily detachably coupled to said basic discharge conduit means, auxiliary connection means carried by said auxiliary foundation for readily detachably connecting said auxiliary pumping mechanism to said control means and to the external source of power for operation of said auxiliary plant module; and coupling means readily detachably coupling said auxiliary intake conduit means to said basic intake conduit means and readily detachably coupling said auxiliary discharge conduit means to said basic discharge conduit means; whereby the pumping capacity of said portable water injection plant may be varied by varying the number of auxiliary plant modules thereof.

8. The portable water injection plant set forth in claim 7, wherein each of said basic and auxiliary intake and discharge conduit means is provided with coupling flanges at the opposite ends thereof, said coupling means including conduit sections each provided with coupling flanges at the opposite ends thereof for coupling to the coupling flanges on said intake and discharge conduit means.

9. The portable water injection plant set forth in claim 7, wherein said basic plant module further includes a thermally insulated basic housing mounted upon said basic portable foundation and cooperating therewith completely to enclose said basic pumping mechanism and conduit means and control means, each said auxiliary plant module further including a thermally insulated auxiliary housing mounted upon said auxiliary portable foundation and cooperating therewith completely to enclose said auxiliary pumping mechanism and conduit means.

10. The portable water injection plant set forth in claim 7, wherein each of said basic and auxiliary pumping mechanisms includes an electric-motor-driven pump and an electric motor for driving same.

11. The portable water injection plant set forth in claim 7, wherein each said auxiliary plant module is adapted to be readily detachably coupled to another auxiliary plant module.

* * * * *